United States Patent [19]

Mason

[11] Patent Number: 4,653,989

[45] Date of Patent: Mar. 31, 1987

[54] OIL WELL PUMPING MECHANISM

[75] Inventor: Hilbur A. Mason, Corpus Christi, Tex.

[73] Assignee: Poly Oil Pump, Inc., Corpus Christi, Tex.

[21] Appl. No.: 798,867

[22] Filed: Nov. 18, 1985

[51] Int. Cl.[4] ..... F04B 9/12

[52] U.S. Cl. ..... 417/392; 166/67; 248/61

[58] Field of Search ..... 417/129, 130, 131, 134, 417/138, 392; 166/67, 68, 242, 243; 285/140, 142, 143; 248/58, 61, 63, 65, 74.1

[56] References Cited

U.S. PATENT DOCUMENTS

| | | | |
|---|---|---|---|
| 248,749 | 10/1881 | Hudson | 417/121 |
| 607,036 | 7/1898 | Harris | 417/121 |
| 971,612 | 10/1910 | Holliday | 417/56 |
| 990,886 | 5/1911 | Lapworth | 417/86 |
| 1,056,709 | 3/1913 | Pollacek et al. | 417/129 |
| 1,666,463 | 4/1928 | McGogy | 417/129 X |
| 2,114,765 | 4/1938 | Hall | 417/86 |
| 3,736,983 | 6/1973 | Beard et al. | 417/121 X |
| 3,825,154 | 7/1974 | Jaeger | 417/63 X |
| 4,050,854 | 9/1977 | Hereford et al. | 417/121 |
| 4,417,858 | 11/1983 | Stout | 417/56 X |
| 4,439,110 | 3/1984 | Massaux | 417/129 |

FOREIGN PATENT DOCUMENTS

| | | | |
|---|---|---|---|
| 2740938 | 3/1979 | Fed. Rep. of Germany | 166/242 |

*Primary Examiner*—Leonard E. Smith
*Attorney, Agent, or Firm*—G. Turner Moller

[57] ABSTRACT

An inexpensive oil well pumping mechanism is largely made of commercially available plastic components. An air line leads from an air compressor at the surface into the well. One or more pumps are connected to the air line and include a pneumatic displacement chamber which is arranged to fill up with formation liquids. A float inside the chamber rises when the chamber fills and trips a valve to allow compressed air entry into the chamber. The chamber accordingly empties into a conduit leading toward the surface.

12 Claims, 6 Drawing Figures

OIL WELL PUMPING MECHANISM

This invention relates to an apparatus for pumping liquids from oil wells.

Conventionally, oil is pumped from a well by the use of a down hole pump, a string of sucker rods extending from the pump upwardly through the tubing to the surface, and a pump jack connected to the rod string. The pump jack comprises a pivoted walking beam connected at one end to the rod string and, at the other end, to a gear box-motor arrangement. When the motor is driven, the walking beam oscillates about its pivot to alternately raise and lower the rod string. On the up stroke, oil is pumped upwardly inside the tubing string. On the down stroke, check valves hold the oil to prevent it from falling back into the hole.

Pumping arrangements of this type run hour after hour, day after day and year after year. Since continued operation and low maintenance costs are prime priorities, great pains are taken in the design and manufacture of conventional pump jacks. This quite obviously leads to high initial costs which can be readily justified in a large majority of oil field pumping situations.

There is one situation in which conventional pump jack—sucker rod—down hole pump arrangements are not particularly suited. This situation involves the producing of small volumes of oil from rather shallow formations. Although such situations occur in quite widely dispersed areas, one typical producing area of this type lies west, southwest and southeast of San Antonio, Tex. In this area, very shallow sandstone formations, typically from 50–1000 feet below the surface, will produce ½–2 barrels of oil per day for rather long periods of time. In these situations, the wells are drilled very close together. Spacings of one well for every 1–2 acres is not unusual. Consequently, one moderately sized lease might have hundreds of wells on it.

The challenge in this situation is to be able to drill and complete the wells and produce the oil in so economic a fashion that profits can be made at a very low rate of production.

One thing that cannot be done in such a situation is to equip each well with a conventional pump jack—sucker rod—down hole pump arrangement. One could easily speed $5000 on a conventional pumping arrangement for a 500 foot well producing one barrel per day. This is a guaranteed recipe to go broke since the payout on the pumping equipment alone would be 250 days. Consequently, there has been a good deal of effort spent in developing pumping arrangements which are considerably less expensive to manufacture and install.

One of the simpliest techniques is to equip the well with a tubing string for delivering the oil to the surface and an air line extending parallel to the tubing string, on the outside thereof having a reverted lower end extending up inside the tubing string. A man with an air compressor on the back of a truck comes to the well everyday and connects the air compressor to the air line. By jetting the well once a day, the oil is produced at a very low initial cost per well. This type system has its disadvantages since daily operating costs are higher than one would like. Another major disadvantage of this type technique is that the amount of oil produced by a well may be substantially lower than the capability of the well. For example, produced in this fashion, a well may fill up the bore hole at the rate of only one barrel per day. On the other hand, if the well could be pumped periodically so that the liquid level in the well is always very low, the feed-in capability of the well might be as high as 3–4 barrels per day. This is a significant difference and is a substantial disadvantage in the technique of daily jetting a well.

Prior art relevant to this invention known to the applicant are U.S. Pat. Nos. 248,749; 607,036; 971,612; 990,886; 1,666,463; 2,114,765; 3,736,983; 4,054,854 and 4,417,858.

This invention comprises a pumping mechanism utilizing a pressurized gas to lift oil from the bottom of a well. Since the most practical pressurized gas is air, this system will be referred to from time-to-time as a pneumatic system, there being no intention of excluding other types of pressurized gases as the operating fluid.

The pump arrangement comprises a displacement chamber lowered into the well which is arranged to fill up with liquid produced from a subterranean formation. The displacement chamber includes a liquid inlet having a check valve therein allowing flow of the formation liquid into the chamber and preventing reverse flow. The chamber includes a pressurized gas inlet connected to a gas conduit extending to the surface. The chamber also includes a gas-liquid outlet connected to an outlet conduit for transporting the pumped liquid away from the chamber toward the surface. A motorized valve in the gas conduit is arranged to open and close the gas conduit in response to a signal for delivering pressurized gas to the displacement chamber. A float in the chamber is arranged to rise when the chamber fills and falls when the chamber empties. The float carries a sensible element which can be detected by a mechanism exterior of the chamber. Means exterior of the chamber are provided to detect the sensible element when the chamber is full to open the motorized valve thereby delivering pressurized gas into the displacement chamber. The pressurized gas displaces the liquid from the chamber into the outlet conduit. When the chamber empties, the position of the float and the sensible element are detected to close the motorized valve and thereby stop delivery of pressurized gas to the displacement chamber.

In very shallow wells, the pumping arrangement of this invention typically comprises only one displacement chamber. When the formation liquid and gas leave the displacement chamber, there is typically a slug of formation liquid followed by a gas bubble. The gas bubble travels upwardly through the outlet conduit to the surface lifting the liquid slug above it. Thus, in one aspect, this invention acts as a gas lift type mechanism which is started in response to the presence of a pumpable quantity of liquid in the displacement chamber.

There is a practical limit to the vertical height that liquid can be pumped with a single displacement chamber of the type herein contemplated. In order to increase the number of situations where the pumping arrangement of this invention can be used, two or more displacement chambers may be positioned vertically in the well. In this invention, the upper chambers are placed in parallel with the outlet conduit. Check valves are strategically located in the outlet conduit so that, when the lower chamber empties, some or all of the pumped liquid comes to rest in the next higher chamber. When the next higher chamber fills, the liquid level is sensed to deliver pressurized gas thereto in order to empty the higher chamber.

One of the unusual features of this invention is that the components parts, except for electrical components, are made from commercially available plastic pipe, fittings and the like. This allows the construction of a pumping arrangement which is not affected by corrosive well fluids, is easy to assemble and which is quite inexpensive.

Another situation where the pumping mechanism of this invention can be used is in a gas well that makes enough water so that the well loads up and dies. A variety of techniques are used to combat this problem. The simpliest solution occurs where the well is producing through a string of $2\frac{7}{8}$ inch O.D. tubing. The operator merely snubs in a string of 1 inch tubing inside the $2\frac{7}{8}$ inch tubing string. The well then produces up the 1 inch tubing. Because of the reduction in flow area, the velocity inside the 1 inch tubing is sufficient to keep water droplets moving upwardly so that the well does not load up and die.

Another technique to overcome this problem occurs where conventional casing, i.e. $4\frac{1}{2}''$ O.D. or $5\frac{1}{2}''$ O.D. casing, is cemented in the well and production is upwardly through a string of $2\frac{1}{2}''$ O.D. tubing. Operators have pulled the string of $2\frac{1}{2}''$ O.D. tubing and packer, run a gas anchor on the bottom of the tubing and run it back into the well. A conventional down hole pump is run into the tubing string and landed at the bottom. In This technique, the produced water is pumped up the tubing string while the gas flow upwardly through the annulus.

The technique of this invention can be used to lift water out of a gas well in lieu of using the conventional pump jack—sucker rod—downhole pump arrangement. In this circumstance, high pressure natural gas is used to lift the water rather than compressed air.

It is an object of this invention to provide an improved pumping arrangement for relatively shallow, relatively low volume wells.

Another object of this invention is to provide a new and improved pumping system for liquid producing wells which is inexpensive to manufacture and assemble in a well.

Other objects and advantages of this invention will become more fully apparent as this description proceeds, reference being made to the accompanying drawings and appended claims.

IN THE DRAWINGS

Figure 1:
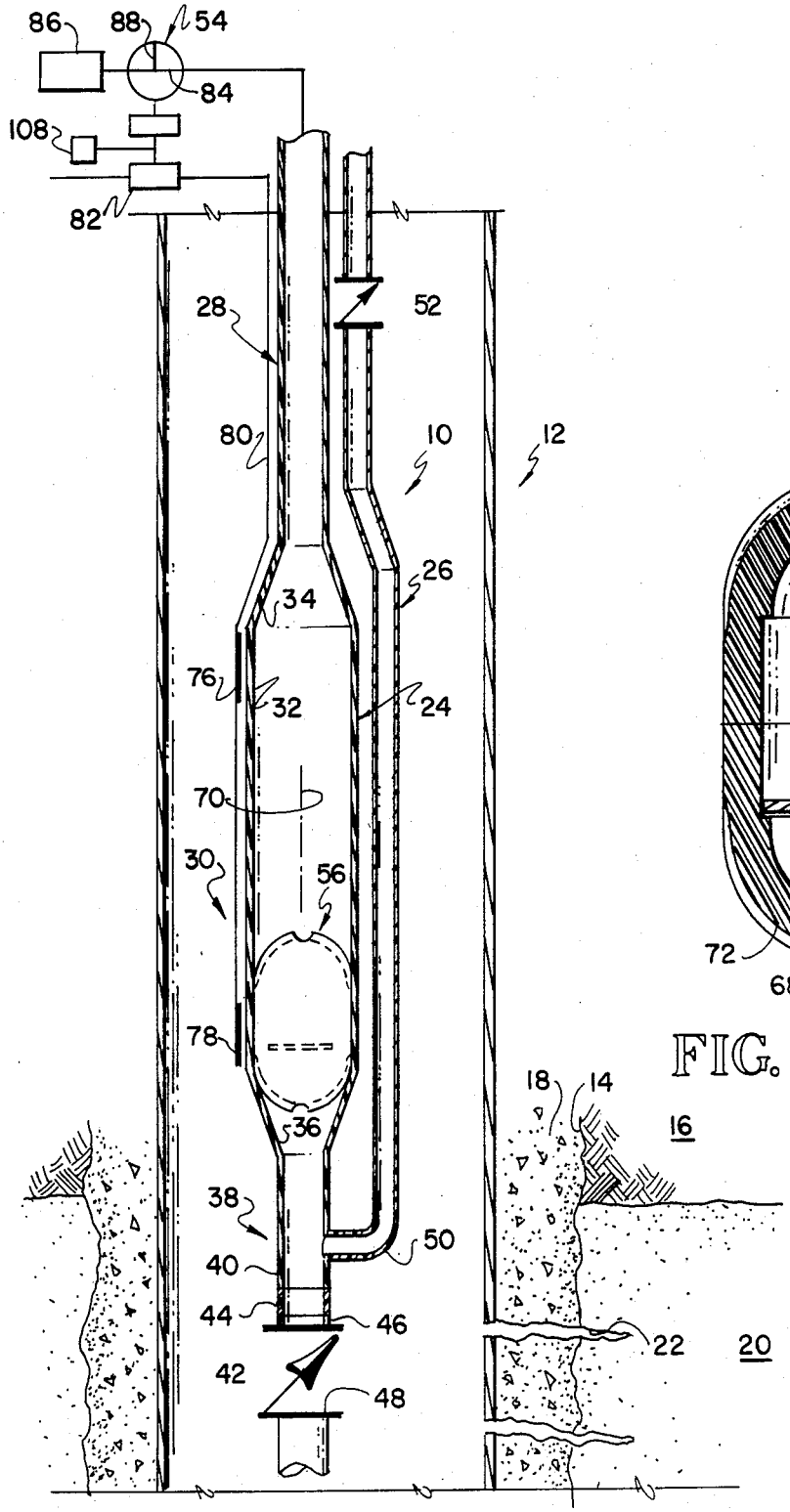
FIG. 1 is a partly cross-sectional partly schematic view of a pumping system of this invention illustrated as positioned inside an oil well.
Figure 2:
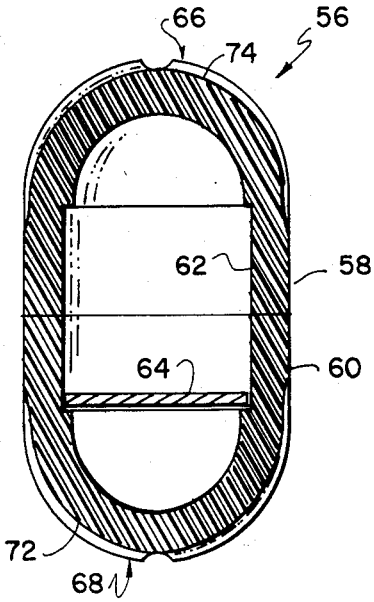
FIG. 2 is an enlarged cross-sectional view of the float illustrated in FIG. 1.

Referring to FIG. 1, a pumping mechanism 10 of this invention is illustrated as disposed in a well 12 comprising a bore hole 14 drilled into the earth in which a string of casing 16 has been cemented by a cement sheath 18. The bore hole 14 penetrates a subterranean formation 20 containing a liquid, usually oil, which is desired to be pumped to the surface. A series of perforations 22 have been formed to communicate formation 20 with the inside of the casing 16.

Prior art pumping mechanisms are typically set somewhat above the top of the producing formation to allow sand or other formation debris to settle out in the rat hole below the producing formation. This is typically done because prior art pumping mechanisms do not tolerate sand very well. On the other hand, the pumping mechanism 10 of this invention may be set so that its lower end is below the top of the producing formation 20 or set above the top of the producing mechanism, at the election of the operator. The pumping mechanism 10 may be set below the top of the producing formation since it tolerates sand fairly well.

The pumping mechanism 10 comprises, as major components, a pneumatic displacement chamber 24, an oil outlet conduit 26, a compressed gas conduit 28 and a system 30 for controlling compressed gas entry into the displacement chamber 24.

The pneumatic displacement chamber 24, like the remainder of the mechanical components of the pumping mechanism 10, is preferably made of organic polymeric materials, typically called plastics, such as polyethylene, polyvinyl chloride, polybutylene or the like. The displacement chamber 24 comprises a length of cylindrical pipe 32 having a reducer 34, 36 fused to each end thereof. Although the pipe 32 may be of any desired size, a 10 foot long section of 2 inch internal diameter polyethylene pipe has proved quite satisfactory.

Secured to the bottom of the reducer 36 is a combined inlet-outlet structure 38. The structure 38 comprises a tee 40 bonded to the lower end of the reducer 36. Below the tee 40 is an inlet 42 for formation liquids. The inlet 42 comprises a coupling 44 bonded to the lower end of the tee 40 and a transition section 46 from plastic to steel threads. Threaded onto the transition section 46 is a commercially available check valve 48.

Connected to the tee 40 and comprising part of the inlet-outlet structure 38 is an outlet elbow 50 connected to the oil outlet conduit 26.

At a location above the displacement chamber 24, a check valve 52 is positioned in the outlet conduit 26 to prevent oil pumped up the hole from falling back into the chamber 24. The check valve 52 is preferably above the chamber 24 because of space problems and to allow oil entry into the conduit 26 below the check valve 52 during fill-up of the chamber 24. It will be seen that the oil outlet conduit 26 and the check valve 52 may be commercially available plastic components compatible with the chamber 24.

Located in the compressed gas inlet conduit 28 is a motorized valve 54, shown in FIG. 1 to be above ground but which may be below ground. The valve 54 is preferably of the solenoid type which may be opened to deliver compressed gas into the chamber 24 and which may be closed to allow liquid entry into the chamber 24.

The control system 30 comprises a float 56 inside the chamber 24 which rises when the chamber 24 fills and which falls when the chamber 24 empties. The float 56 is closely but not sealingly received in the chamber 24 and is desirably made of commercially available plastic fittings of the type normally used with plastic pipe. To this end, the float 56 conveniently comprises a pair of end caps 58, 60 providing a cavity 62 therebetween. Received in the cavity 62 is a disk shaped magnet 64 which comprises an element sensed by the control system 30 to open and close the motorized valve 54.

In its assembled condition, the end caps 58, 60 provide a cylindrical wall having domed ends 66, 68. It will accordingly be seen that the float 56 rides up and down inside the displacement chamber 24 and cannot turn end-to-end thereby preventing misorientation of the disk shaped magnet 64. It is, of course, feasible for the float 56 to rotate about a longitudinal axis 70 of the chamber 24. This does not, of course, misorient the magnet 64 since it is disk shaped.

It is conceivable that the dome shaped lower end 68 of the float 56 could seal against the tapered surface of the reducer 36 thereby acting as a valve to prevent liquid or gas flow through the bottom opening of the chamber 24. To avoid this possibility, flutes are provided between the lower domed end 68 and the internal surface of the reducer 36. Conveniently, the flutes 72 are provided in the lower end 68 merely by cutting away the plastic material of the domed end 68 with an edge of a grinding wheel. Similar flutes 74 on the upper domed end 66 are, in the assemblied condition of the float 56, wholly useless. By providing the flute 74 on the upper domed end 66, the float 56 becomes symmetrical so that it is impossible to insert the float 56 upside down inside the chamber 24.

The control system 30 includes a pair of reed switches 76, 78 on the exterior of the chamber 24 adjacent the upper and lower ends thereof respectively. It will accordingly be seen that when the chamber 24 fills and the float 56 rises to the top thereof, the reed switch 76 is manipulated. Conveniently, the reed switch 76 is of the normally open type and is closed by the appearance of the magnetic field created by the magnet 64. When the switch 76 closes, a circuit is completed through a conduit 80 between the switch 76 and a stepping or latching relay 82 at the surface. When the latching relay or SCR or Triac switching device 82 is moved to its on position, it energizes the motorized valve 54 to allow air entry into the air delivery conduit 28.

As pressurized gas is delivered into the conduit 28, oil or other liquid in the displacement chamber 24 is moved downwardly and into the outlet elbow whereupon it begins to move upwardly through the oil outlet conduit 26. The float 56 accordingly falls inside the displacement chamber 24 until it reaches the location of the lower reed switch 78. The lower reed switch 78 is of the normally open type and is closed by the appearance of the magnetic field created by the magnet 64. When the switch 78 closes, a circuit is completed through the cable 80 to the latching relay 82. When the lower reed switch 78 is closed, this manipulates the latching relay 82 to its off position thereby closing the motorized valve 54 and terminating air entry into the conduit 28 and cylinder 24.

The motorized valve 54 is desirably of the three-way type having a first passage 84 for delivering compressed air from an air compressor 86 into the conduit 28. A second passage 88 in the valve 54 acts to vent the conduit 28 when the latching relay de-energizes the valve 54 for movement toward its closed position. Accordingly, compressed air in the conduit 28 and the chamber 24 exhausts to the atmosphere thereby allowing fluid entry through the check valve 48 and inlet 42 into the chamber 24 so that another pumping cycle begins.

One of the difficulties in running plastic pipe into a well is that the pipe tends to elongate or creep due to the tensile load on the pipe. Thus, there is a practical limit to the depth that plastic pipe can be run in a well.

Figure 3:
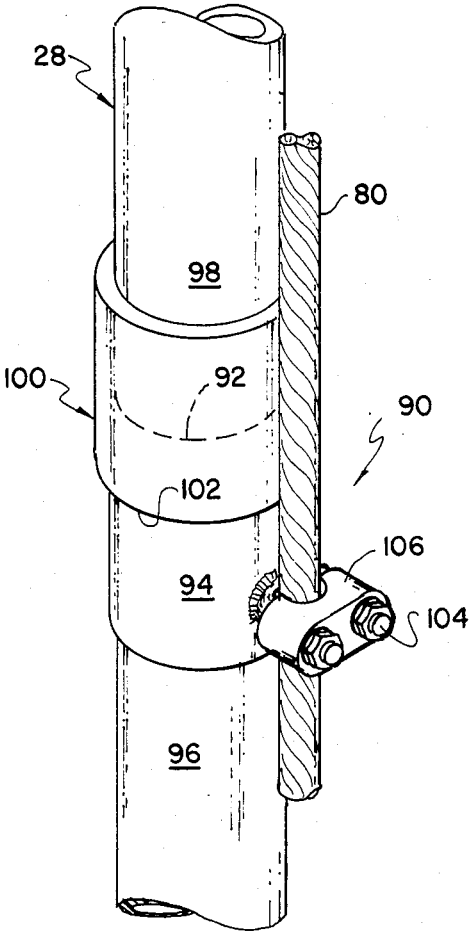
FIG. 3 is an isometric view of a technique used to support a plastic conduit inside the well.

Referring to FIG. 3, there is illustrated means 90 for supporting the pressurized gas conduit 28 to prevent it from creeping. The supporting means 90 are located in the well at desirable intervals, usually every 150–200 feet. When the pipe 28 is being run into the well, the electrical cable 80 is run concurrently therewith. The electrical cable 80 is preferably of the type presently used in the oil field on electric logging trucks and comprises several electrically insulated conductors along with a wound series of wire strands. The cable 80 is accordingly quite strong in tension and provides a support for the conduit 28. When a position is reached where it is desired to install the supporting means 90, the conduit 28 is cut along a line 92. A steel collar 94 is passed over the severed lower end 96. The ends 96, 98 are reattached by the use of a polyethylene coupling or socket 100 which is fused to the ends 96, 98. The coupling 100 provides a lower shoulder 102 which abuts the upper shoulder of the collar 94 in a load transferring relation.

The collar 94 includes a U bolt 104 welded to the body of the collar 94. The U bolt 104 is of a size to receive the cable 80 and is connected thereto by a cable clamp 106. It will accordingly be seen that the collar 94 is rigidly connected to the cable 80 by the cable clamp 106. The coupling 100 and the conduit 28 are free to move up and down inside the metal collar 94 until the lower shoulder 102 of the coupling 100 comes into load supporting engagement with the upper shoulder of the metal collar 94. Further downward movement of the conduit 28 is thus prevented and the conduit 28 is accordingly supported against creep or elongation due to the tensile load.

The oil return conduit 26 may also suffer from creep or elongation due to tensile load and is supported from the cable 80 by other supporting means 90.

In a situation where the pumping mechanism 10 is being used to pump oil, there are typically a very large number of wells on the same lease. Typically, a large number of wells will be connected to produce into a common tank battery. By gauging the tank battery daily, the operator can determine how much oil is being produced by all of the wells. The operator does not know, on a daily basis, how much oil is being produced from each of the wells. This information can be obtained, at present, either by placing a liquid meter on the flow line leading from each of the wells, by connecting the tested well to a separate tank or the like. It will suffice to say that measuring the production daily from a large number of oil wells producing to a common tank battery is neither convenient nor inexpensive.

This invention provides an opportunity to overcome this problem in a simple and expeditious manner. The cylinder 24 is of known internal capacity and delivers a predictable quantity of oil during each pumping cycle. For example, with a two inch I.D. and ten foot long cylinder, the quantity pumped is about one gallon per cycle. By placing a counter 108 at the surface connected to the output of the latching relay 82 or the input to the motorized valve 54, the counter 108 is tripped every time the motorized valve 54 is opened. Thus, the counter 108 provides a cumulative indication of the number of strokes of the pumping mechanism 10. If the gauger were to read the counter 108 daily, he could readily determine the number of pump cycles of each well equipped with the pumping mechanism 10 of this invention and thereby determine the relative productivity of the wells.

Figure 4:
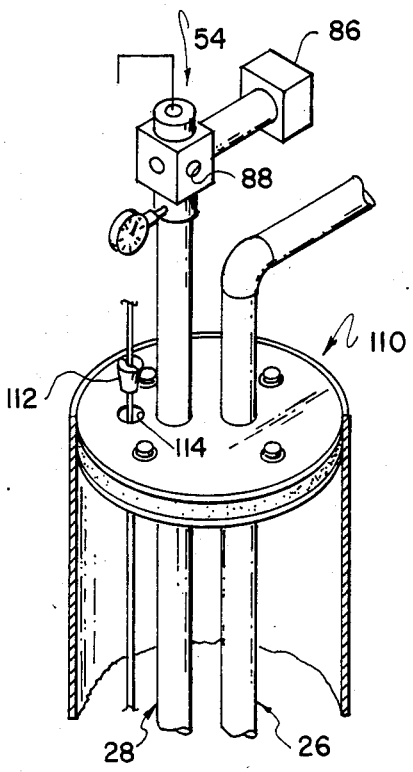
FIG. 4 is a partial cross-sectional view of a typical well head assembly.

Referring to FIG. 4, there is illustrated a typical surface or well head installation. The air conduit 28 and the oil flow line 26 pass through a casing head arrangement 110. The upper end of the cable 80 is supported from the casing head 110 in any suitable manner, as by the use of a set of split cable slips 112 received in an opening 114 in the casing head 110.

Operation of the embodiment of FIGS. 1–4 is now believed apparent. One unusual aspect warrants mentioning. Wells equipped basically as shown in FIGS. 1–4 have operated quite satisfactorily. The unusual aspect is that, when pumping, a solid stream of oil is delivered from the outlet conduit 26. It is conceivable that there is some air dissolved in the oil delivered from the conduit 26. It is clear, however, that there are no large air bubbles which are readily seen by an observer. There are believed to be two causes of this behavior. First, the float 56 tends to separate the liquid in the cylinder 24 from the air applied thereto without allowing much mixing. Second, when the float 56 reaches the bottom and manipulates the switch 78, pumping stops almost immediately. This is believed due, to a large extent, to the venting of compressed air in the conduit 28 to the atmosphere.

The pumping mechanism 10 of FIGS. 1–4 cannot pump from beyond a depth which is dictated by the air pressure which can be delivered to the air supply conduit 28 which is, of course, a function of the pressure capacity of the conduit 28 and/or the cylinder 24. To overcome this limitation, two or more displacement cylinders may be placed in series at spaced locations inside a well.

Figure 5:
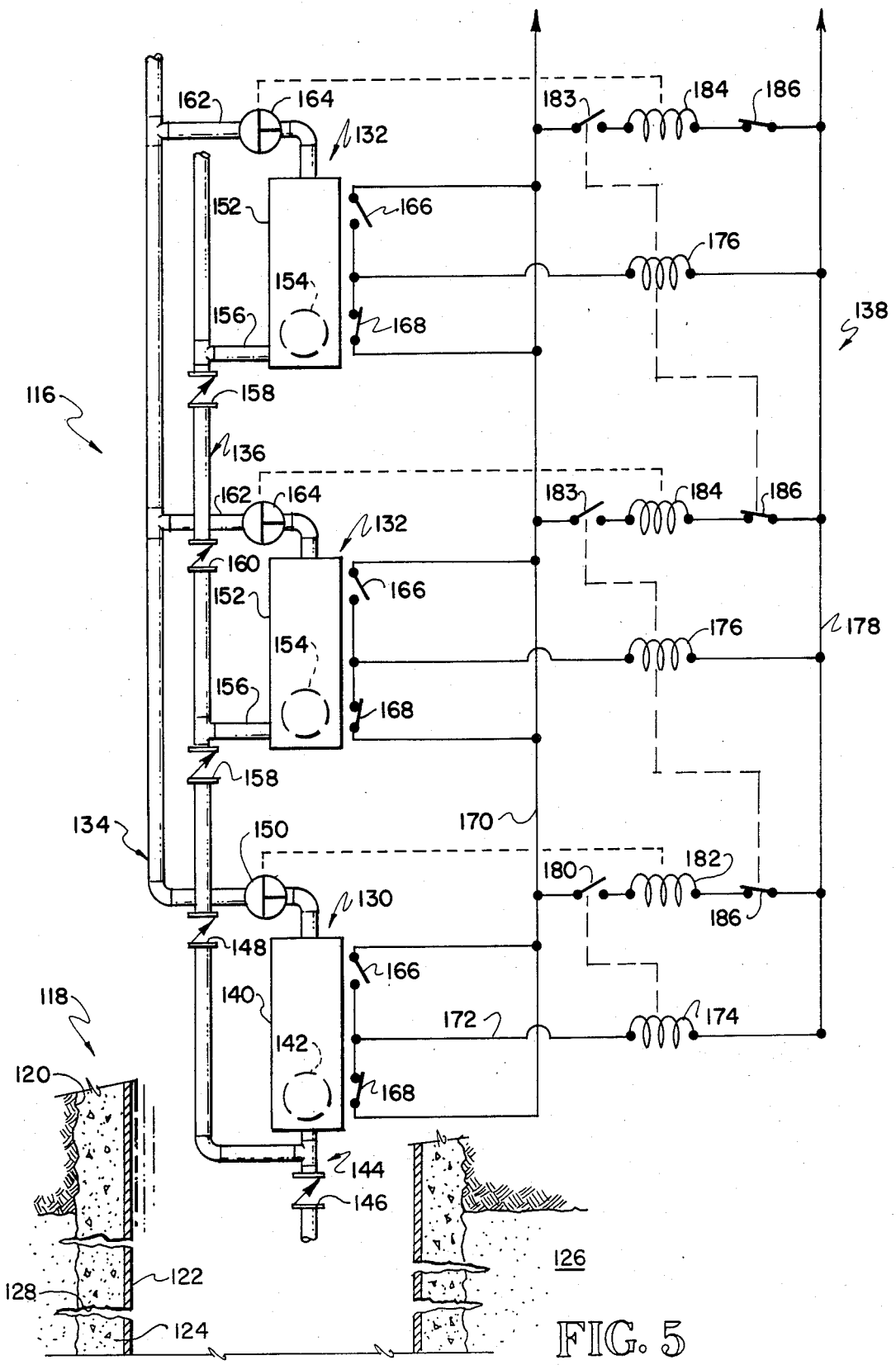
FIG. 5 is a largely schematic view illustrating a multipump assembly for pumping liquids from a relatively deeper well.

To this end, FIG. 5 illustrates a pumping system 116 of this invention disposed in a well 118 comprising a bore hole 120 drilled into the earth in which a string of casing 122 has been cemented by a cement sheath 124. The bore hole 120 penetrates a subterranean formation 126 containing a liquid, usually oil, which is desired to be pumped to the surface. A series of perforations 128 have been formed to communicate the formation 126 with the inside of the casing 122.

The pumping system 116 comprises a lowermost pump unit 130, one or more substantially identical upper pump units 132, an air inlet conduit 134, an oil flow line 136 and a control system 138 for manipulating the various pump units 130, 132.

The lowermost pump unit 130 may be substantially identical to the unit illustrated in FIG. 1 and comprises a displacement cylinder 140 having a float 142 therein and an inlet-outlet structure 144 providing a check valve 146 on the inlet. The oil conduit 136 connects to the inlet-outlet structure 144 between the check valve 146 and the bottom of the cylinder 140. The air inlet conduit 134 connects to the top of the cylinder 140 and provides a motorized valve 150 therein.

The lower most pump unit 130 operates substantially the same as the unit shown in FIG. 1 and delivers essentially air free oil into the oil outlet conduit 136. A check valve 148 is positioned at a location comparable to the check valve 52 in the embodiment of FIG. 1.

The upper pump unit 132 is quite similar to the lowermost pump unit 130 and comprises a displacement cylinder 152 having a float 154 therein and a branch conduit 156 opening into the oil return line 136 immediately above a check valve 158. A second check valve 160 is disposed above the cylinder 152 in a relationship substantially the same as the check valve 148 bears to the cylinder 140. Connected to the top of the cylinder 152 is a branch conduit 162 leading to the compressed air line 134 and having therein a motorized valve 164 for controlling air entry to the cylinder 152.

Operation of the pump units 130, 132 is substantially the same as in the embodiment of FIG. 1. The only difference in operation is that the unit of FIG. 1 pumps whenever the cylinder 24 fills. In the embodiment of FIG. 5, the uppermost pump 132 is allowed to pump whenever its cylinder 152 fills. The remaining pump units 130, 132 are desirably not allowed to pump unless the cylinder immediately above it is empty, or substantially empty.

The control system 138 includes upper and lower reed switches 166, 168 associated with each of the displacement cylinders 140, 152 as in the embodiment of FIG. 1. One leg of the switches 166, 168 connect to an insulated conductor 170 inside a cable (not shown) similar to the cable 80. The other leg of the switches 166, 168 connect to a conductor 172 having a solenoid coil 174, 176 therein which connects to an insulated conductor 178 in the same cable (not shown).

The solenoids 174, 176 are part of a stepping or latching relay. The solenoid 174, associated with the lowermost pump unit 130, acts to close a relay 180 having a solenoid coil 182 therein comprising the motor for the motorized valve 150. Thus, when the float 142 closes the normally opened switch 166, the solenoid 174 is energized thereby latching the relay 180 in its closed position to energize the solenoid 182 and open the valve 150. When the float 142 falls to its empty position, the normally opened switch 168 is closed thereby energizing the solenoid 174 to open the relay 180 to deenergize the solenoid 182. It will be appreciated that the solenoid 174 and the switch 180 comprise a stepping or latching relay wherein energization of the solenoid 174 latches the switch 180 in a closed position which stays closed until the solenoid 174 is again energized whereupon the switch 180 is latched in an open position.

The only difference in the control system 138 associated with the upper pump units 132 is that povision is made to prevent energization of the next lower pump in the event a displacement cylinder is full. To this end, the solenoids 176 act to close a switch 183 thereby energizing a solenoid 184 to manipulate the motorized valve 174. At the same time, the solenoids 176 open a switch 186 in circuit with the valve operating solenoids 182, 184 of the next lower pump unit. Accordingly, when the uppermost pump unit 132 is pumping and delivering oil into the conduit 136, the switch 186 of the next lower pump unit 132 is opened thereby preventing energization of the solenoid 184 and opening of the valve 164. When the lower reed switch 168 is closed, signifying that the cylinder 152 is empty, the solenoid 176 is energized to open the switch 183 and close the switch 186 of the next lower pump unit.

Each solenoid 176 and its associated switches 183, 186 comprise a stepping or latching relay so that the switches 183, 186 are manipulated each time the solenoid 176 is energized and remain in that position until the solenoid 176 is again energized.

In the embodiment of FIG. 5, the motorized valves. 150, 164 vent the compressed air in the cylinder 152 inside the casing 122. Thus, the casing 122 must be vented at the surface in order to prevent a buildup of pressure inside the well 118 which will impede the flow of oil from the formation 126 into the casing 122. It may be desirable, under some circumstances, to vent the cylinders 140, 152 into a separate vent line which leads to the surface.

Figure 6:
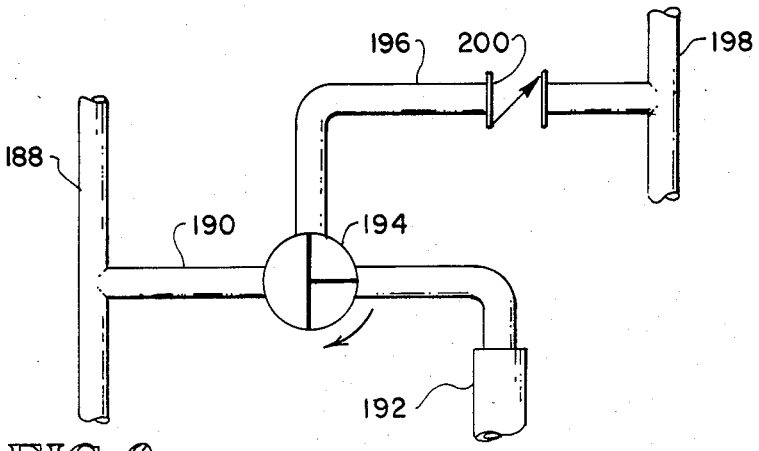
FIG. 6 is a schematic view showing a modification of the embodiment of FIG. 5.

This configuration is illustrated in FIG. 6 where an air supply conduit 188 connects through a branch line 190 to the upper end of a displacement cylinder 192. A three-way valve 194 is positioned in the branch conduit 190 and connects to a branch conduit 196 leading to a vent line 198 extending out of the well. The branch conduit 196 may but does not have to include a check valve 200 therein. As illustrated, the arrangement of FIG. 6 is venting the cylinder 192 to atmosphere through the vent line 198. When it is sensed that the cylinder 192 is full, the valve 194 is manipulated in a clockwise direction to connect the cylinder 192 to the air supply line 188. After the cylinder 192 is emptied, the valve 194 is rotated in a counterclockwise direction to vent the cylinder 192.

Although the invention has been described in its preferred forms with a certain degree of particularity, it is understood that the present disclosure is only by way of example and that numerous changes in the details of construction and in the combination and arrangement of parts may be resorted to without departing from the spirit and scope of the invention as hereinafter claimed.

I claim:

1. Apparatus for pumping liquid from a well to the surface, comprising a production string cemented in the well;

a down hole pumping mechanism inside the production string having electrical means thereon;

a conduit connected to the pumping mechanism and extending to the surface, the conduit being made of an organic polymeric material having a tendency to stretch when placed in tension;

an electrically insulated cable supported at the surface, extending into the well and connected to the electrical means on the down hole pumping mechanism; and means connecting the cable to the conduit at vertically spaced locations in the well for transferring at least part of the weight of the conduit to the cable.

2. Apparatus for pumping liquid from a well to the surface, comprising a down hole pumping mechanism;

a conduit connected to the pumping mechanism and extending to the surface, the conduit being made of an organic polymeric material having a tendency to stretch when placed in tension;

a cable supported at the surface and extending into the well; and means connecting the cable to the conduit at vertically spaced locations in the well for transferring at least part of the weight of the conduit to the cable, the connecting means comprises a downwardly facing shoulder on the exterior of the conduit, a metallic sleeve slideably receiving the conduit at a location below the downwardly facing shoulder and having an upwardly facing shoulder for load supporting engagement with the downwardly facing shoulder, and means for connecting the sleeve to the cable.

3. A liquid displacement pump for pumping a liquid from a subterranean formation through a well, comprising a displacement chamber comprising a length of pipe of organic polymeric material having a pipe reducer at the lower end thereof providing a bottom opening, a liquid inlet comprising a first conduit connected to the bottom opening and having a check valve therein, a pressurized gas inlet and an outlet comprising a second conduit opening into the first conduit between the check valve and the bottom opening, the first and second conduits being the size of the lower end of the pipe reducer, the chamber being arranged to deliver the pumped liquid through the outlet when pressurized gas flow through the gas inlet and arranged to fill up with liquid when no pressurized gas flows through the gas inlet;

an outlet conduit connected to the liquid outlet for transporting the pumped liquid away from the chamber;

a gas conduit connected to the gas inlet for delivering a pressurized gas to the chamber;

a motorized valve in the gas conduit for opening and closing the gas conduit in response to a signal;

a float in the chamber arranged to rise to a first location when the chamber fills and fall to a second location when the chamber empties and including a sensible element the float comprising a generally cylindrical section closely but not sealingly received in the chamber pipe and having semi-spherical upper and lower ends, the lower end having flutes therein; and means responsive to the sensible element at the first location for opening the motorized valve and responsive to the sensible element at the second location for closing the motorized valve.

4. The liquid pump of claim 3 wherein the float comprises a pair of pipe end caps of organic polymeric material, the end caps being secured together.

5. A liquid displacement pump for pumping a liquid from a subterranean formation through a well having a string of production casing therein, comprising an elongate displacement chamber having an inner chamber wall, a longitudinal dimension and a much smaller transverse dimension sufficiently small to pass into the string of production casing, a liquid inlet, a check valve in the inlet, a pressurized gas inlet and an outlet, the chamber being arranged to deliver the pumped liquid through the outlet when pressurized gas flow through the gas inlet and arranged to fill up with liquid when no pressurized gas flows through the gas inlet;

an outlet conduit connected to the outlet for transporting the pumped liquid away from the chamber;

a gas conduit connected to the gas inlet for delivering a pressurized gas to the chamber;

a motorized valve in the gas conduit for opening and closing the gas conduit in response to a signal;

a float in the chamber arranged to rise to a first location when the chamber fills and fall to a second location when the chamber empties, the float being closely but not sealingly received in the chamber and being unconstrained from lateral movement in the chamber except for contact with the inner chamber wall and including a sensible element; and means responsive to the sensible element at the first location for opening the motorized valve and responsive to the sensible element at the second location for closing the motorized valve.

6. The liquid pump of claim 5 wherein the chamber outlet is disposed adjacent a lower end of the chamber, and the outlet conduit extends upwardly past the chamber and further comprising a check valve in the outlet conduit above the chamber for allowing the outlet conduit below the check valve to fill up with formation liquid during each pumping cycle.

7. The liquid pump of claim 5 wherein the displacement chamber comprises a length of pipe of organic polymeric material having a pipe reducer at the lower end thereof providing a bottom opening, the liquid inlet comprising a first conduit connected to the bottom opening and having a check valve therein, the gas-liquid outlet comprising a second conduit opening into the first conduit between the check valve and the bottom opening, the first and second conduits being the size of the lower end of the pipe reducer.

8. The liquid pump of claim 5 further comprising a second elongate displacement chamber having an inner chamber wall, a longitudinal dimension and a much smaller transverse dimension sufficiently small to pass into the string of production casing, a liquid inlet connected to the outlet conduit at a location above the first chamber, a check valve in the inlet of the second chamber, a pressurized gas inlet, a branch conduit connecting the gas inlet of the second chamber to the gas conduit and an outlet connected to the outlet conduit, the second chamber being in parallel to the outlet conduit;

a second motorized valve in the branch conduit for opening and closing the branch conduit in response to a signal;

a second float in the second chamber arranged to rise to a third location when the second chamber fills and fall to a fourth location when the second chamber empties, the float being closely but not sealingly received in the second chamber and being unconstrained from lateral movement in the chamber except for contact with the inner chamber wall and including a sensible element; and means responsive to the sensible element in the second chamber at the third location for opening the second motorized valve and responsive to the sensible element at the fourth location for closing the second motorized valve.

9. The liquid pump of claim 8 further comprising selector means allowing delivery of pressurized gas to the second chamber in preference to delivery of pressurized gas to the first chamber if both chambers are full.

10. The liquid pump of claim 9 wherein the selector means comprises means responsive to the sensible element in the second chamber at the third location for disabling the responsive means of the first chamber.

11. The liquid pump of claim 5 wherein the float provides a cavity therein and the sensible element is a magnet in the cavity.

12. The liquid pump of claim 11 wherein the float comprises an elongate section having a longitudinal dimension greater than the transverse dimension of the chamber on the inside thereof and a transverse dimension substantially less than the longitudinal dimensions thereof.

* * * * *